US011732409B2

(12) United States Patent
Robles Flores et al.

(10) Patent No.: US 11,732,409 B2
(45) Date of Patent: Aug. 22, 2023

(54) TEXTILES CUSTOM PRINTED WITH ANTIMICROBIAL NANOPARTICLES

(71) Applicant: Xerox Corporation, Norwalk, CT (US)

(72) Inventors: Eliud Robles Flores, Rochester, NY (US); Yu Qi, Penfield, NY (US); Judith Millner Vandewinckel, Livonia, NY (US)

(73) Assignee: XEROX CORPORATION, Norwalk, CT (US)

( * ) Notice: Subject to any disclaimer, the term of this patent is extended or adjusted under 35 U.S.C. 154(b) by 245 days.

(21) Appl. No.: 17/060,511

(22) Filed: Oct. 1, 2020

(65) Prior Publication Data

US 2022/0106735 A1 Apr. 7, 2022

(51) Int. Cl.

| | |
|---|---|
| ***D06P 5/00*** | (2006.01) |
| ***D06P 1/52*** | (2006.01) |
| ***G03G 9/08*** | (2006.01) |
| ***G03G 9/087*** | (2006.01) |
| ***G03G 15/00*** | (2006.01) |

(Continued)

(52) U.S. Cl.

CPC ..... *D06P 5/001* (2013.01); *B41J 3/4078* (2013.01); *D06M 11/83* (2013.01); *D06M 16/00* (2013.01); *D06P 1/5271* (2013.01); *G03G 7/0093* (2013.01); *G03G 9/0819* (2013.01); *G03G 9/08755* (2013.01); *G03G 15/6591* (2013.01); *G03G 2215/00527* (2013.01)

(58) Field of Classification Search

CPC ..... D06P 5/001; D06P 1/5271; B41J 3/4078; D06M 11/83; D06M 16/00; G03G 7/0093; G03G 9/0819; G03G 9/08755; G03G 15/6591; G03G 2215/00527

See application file for complete search history.

(56) References Cited

U.S. PATENT DOCUMENTS 4,810,006 A * 3/1989 Katz ..... B42D 5/02 281/5
5,247,334 A * 9/1993 Miyakawa ..... G03G 15/0147 399/154

(Continued)

FOREIGN PATENT DOCUMENTS

CN 102561043 A * 7/2012
CZ 9901804 A3 * 10/2000 ..... B29C 67/0074

(Continued)

*Primary Examiner* — Ryan D Walsh

(74) *Attorney, Agent, or Firm* — MH2 Technology Law Group LLP

(57) ABSTRACT

According to various embodiments, a method of forming an image on a fabric and the resulting fabric is disclosed. The method includes providing a printable media including a carrier layer having a first surface comprising a first area and a second surface opposite the first surface. The method includes providing a fabric layer having a third surface and a fourth surface opposite the third surface, the third surface includes a second area. The fabric layer is secured to the carrier layer by the adhesive bonding a first portion of the fourth surface to the first surface. The method includes applying a toner to a first portion of the third surface of the fabric layer. The toner includes antimicrobial nanoparticles on an outer surface of the toner. The method includes fusing the toner to the first portion of the third surface of the fabric layer.

24 Claims, 5 Drawing Sheets

(51) Int. Cl.

| | |
|---|---|
| ***D06M 11/83*** | (2006.01) |
| ***D06M 16/00*** | (2006.01) |
| ***G03G 7/00*** | (2006.01) |
| ***B41J 3/407*** | (2006.01) |

(56) References Cited

U.S. PATENT DOCUMENTS

| | | | | |
|---|---|---|---|---|
| 9,550,374 | B1 * | 1/2017 | Marino | B41J 3/4078 |
| 9,574,036 | B2 | 2/2017 | Farrugia et al. | |
| 10,007,200 | B2 | 6/2018 | Farrugia et al. | |
| 10,113,059 | B2 | 10/2018 | Farrugia et al. | |
| 10,216,111 | B2 | 2/2019 | Farrugia et al. | |
| 10,358,563 | B2 | 7/2019 | Farrugia et al. | |
| 10,405,540 | B2 | 9/2019 | Farrugia et al. | |
| 10,444,650 | B2 | 10/2019 | Farrugia | |
| 2002/0054781 | A1 * | 5/2002 | Korem | B41J 3/4078 400/621 |
| 2004/0062897 | A1 * | 4/2004 | Samii | B41J 3/4078 428/40.1 |
| 2009/0227163 | A1 * | 9/2009 | Perry | B32B 27/10 442/65 |
| 2013/0071143 | A1 | 3/2013 | Blanton et al. | |
| 2017/0038376 | A1 * | 2/2017 | Farrugia | G03G 9/08795 |
| 2018/0171540 | A1 * | 6/2018 | Agarwal | D06M 15/15 |
| 2018/0296864 | A1 * | 10/2018 | Feasey | A62B 18/003 |

FOREIGN PATENT DOCUMENTS

| | | | | |
|---|---|---|---|---|
| EP | 1291188 | A1 * | 3/2003 | B41J 15/046 |
| EP | 3421553 | A1 * | 1/2019 | B41J 11/0015 |
| WO | WO-03095735 | A2 * | 11/2003 | D06M 11/155 |
| WO | WO-2018110630 | A1 * | 6/2018 | B41J 11/0095 |
| WO | WO-2021247720 | A1 * | 12/2021 | |

* cited by examiner

TEXTILES CUSTOM PRINTED WITH ANTIMICROBIAL NANOPARTICLES

BACKGROUND

Field of Use

The present disclosure relates, in various embodiments, to textiles printed with antimicrobial particles and a method thereof.

Background

In today's environment, during the virus pandemic of COVID-19, the medical field is in dire need for antimicrobial, antibacterial, and antifungal applications in equipment, accessories, and clothing.

There is a growing interest in embedding nanometals into polymer matrices due to the potential applications that are possible. Most methods for nanometal structured materials such as silver nanoparticles, require that the silver salt precursor be reduced in a chemical reaction prior to incorporation into polymer matrices. The most widely used silver ion precursor for the synthesis of silver nanoparticles (AgNPs) is silver nitrate ($AgNO_3$). The most readily used reducing agents for the synthesis of AgNPs are sodium borohydride or sodium citrate. The most common stabilizing agents for nanosilver are citrate and PVP (polyvinylpyrrolidone).

Conventional methods for making silver/polymer nanostructured materials generally require the melt mixing or extrusion of AgNPs in polymer matrixes which lead to aggregated silver particles. Other methods use in situ synthesis of metal nanoparticles in polymer matrixes which involves the dissolution and reduction of metal salts/or simultaneously with polymer synthesis. The polymer matrix has a role in keeping the AgNPs dispersed as well as maintaining overall chemical and mechanical stability.

Methods for the synthesis of core-shell or hybrid colloid dispersions currently lack control of morphology and the resulting properties are generally inferior. It has also been found that most conventional methods require filtration, sedimentation, and centrifugation processes, which are challenging and time consuming.

Additionally, it is known that uncoated silver nanoparticles can be toxic, but when protected by an organic layer or embedded within an organic matrix they become less toxic or in other words biocompatible.

It would be desirable if textiles could be impregnated or imprinted biogenic silver nanoparticles (AgNPs). This would open up the possibility for their use in medical environment and agriculture clothing as means to avoid microbial spreading. This would also enable preventing microbial growth in textiles for common use such as facemasks, gloves, and scarves.

SUMMARY

According to various embodiments, there is provided a method of forming an image on a fabric. The method includes providing a printable media including a carrier layer having a first surface comprising a first area and a second surface opposite the first surface. The carrier layer has a first rigidity. The method includes providing a fabric layer having a third surface and a fourth surface opposite the third surface, the third surface includes a second area. The fabric layer has a second rigidity less than the first rigidity.

There is a first adhesive. The fabric layer is secured to the carrier layer by the first adhesive bonding a first portion of the fourth surface to the first surface. The method includes applying a toner to a first portion of the third surface of the fabric layer. The toner has a size of from 4 microns to about 20 microns. The toner includes antimicrobial nanoparticles on an outer surface of the toner, the antimicrobial nanoparticles have a size of from 5 nanometers to 500 nanometers. The method includes fusing the toner to the first portion of the third surface of the fabric layer.

A further aspect described herein is a printed article including a fabric having first surface and a second surface opposite the first surface. A toner image is disposed on the first surface of the fabric, wherein the toner image comprises toner particles having a size of from 4 microns to about 20 microns and antimicrobial nanoparticles an outer surface of the toner. The antimicrobial nanoparticles have a size of from 5 nanometers to 500 nanometers.

A further aspect described herein is a method of forming an image on a fabric. The method includes providing a printable media having a carrier layer having a first surface and a first area, a second surface opposite the first surface, and a first rigidity. The method includes a fabric layer comprising a third surface and a fourth surface opposite the third surface and having a second area, and a second rigidity less than the first rigidity. The method includes a adhesive. The fabric layer is secured to the carrier layer by the adhesive bonding a first portion of the fourth surface to the first surface. The method includes applying a toner to a first portion of the third surface of the fabric layer, wherein the toner comprises a size of from 4 microns to about 20 microns. The toner includes antimicrobial nanoparticles, the antimicrobial nanoparticles have a size of from 5 nanometers to 500 nanometers. The method includes fusing the toner to the first portion of the third surface of the fabric layer.

BRIEF DESCRIPTION OF THE DRAWINGS

The accompanying drawings, which are incorporated in and constitute a part of this specification, illustrate several embodiments of the present teachings and together with the description, serve to explain the principles of the present teachings.

It should be noted that some details of the FIGS. have been simplified and are drawn to facilitate understanding of the embodiments rather than to maintain strict structural accuracy, detail, and scale.

DESCRIPTION OF THE EMBODIMENTS

In the following description, reference is made to the chemical formulas that form a part thereof, and in which is shown by way of illustration specific exemplary embodiments in which the present teachings may be practiced. These embodiments are described in sufficient detail to enable those skilled in the art to practice the present teachings and it is to be understood that other embodiments may be utilized and that changes may be made without departing from the scope of the present teachings. The following description is, therefore, merely exemplary and non-limiting.

Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

Although embodiments of the disclosure herein are not limited in this regard, the terms "plurality" and "a plurality" as used herein may include, for example, "multiple" or "two or more." The terms "plurality" or "a plurality" may be used throughout the specification to describe two or more components, devices, elements, units, parameters, or the like. For example, "a plurality of resistors" may include two or more resistors.

Figure 1:
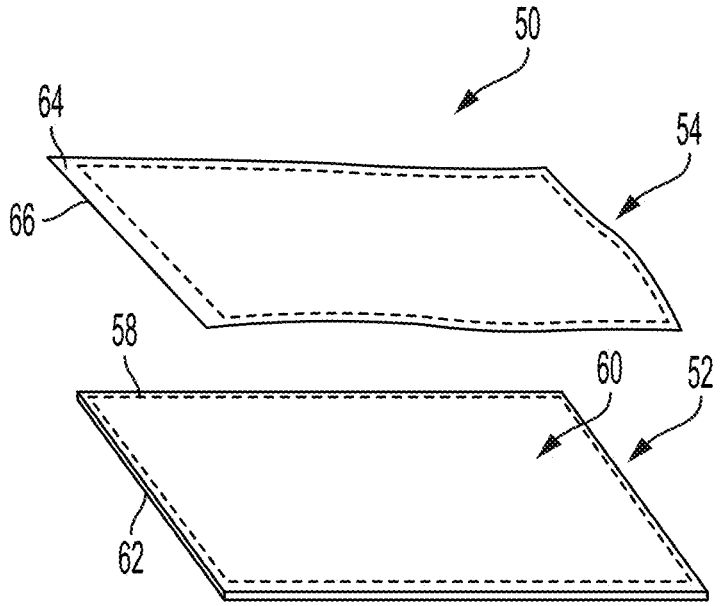
FIG. 1 is a perspective view of an embodiment of a carrier layer and a fabric layer separated from each other.
Figure 2:
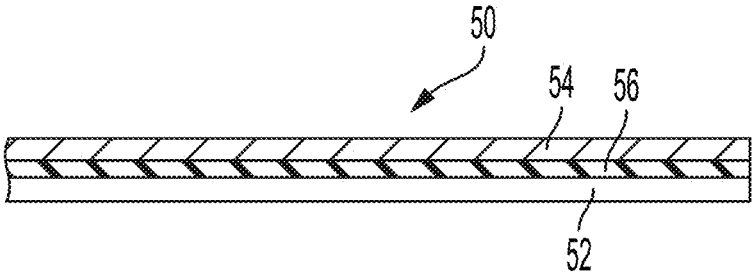
FIG. 2 is a cross sectional view of an embodiment of a present printable media depicting a fabric layer releasably secured to a carrier layer via an adhesive.

Broadly, in some embodiments, shown in FIG. 1 and FIG. 2, printable media 50 includes carrier layer 52, fabric layer 54 and adhesive 56. Carrier layer 52 comprises surface 58 comprising area 60, surface 62 opposite surface 58, and a first rigidity. Fabric layer 54 comprises surface 64, surface 66 opposite surface 64 and a second rigidity less than the first rigidity. Fabric layer 54 is secured to carrier layer 52 by adhesive 56 bonding portion of surface 66 to surface 58.

In some embodiments, adhesive 56 is deposited on area 60, and in some of those embodiments, area 60 is less than or equal to total area of surface 58. In some embodiments, adhesive 56 is deposited on surface 66, and in some of those embodiments, area on surface 66 is less than or equal to total area of surface 58. In some embodiments, area 60 substantially equal to area on surface 66. In summary, an adhesive may be deposited on the carrier layer 52 and/or on the fabric layer 54. Moreover, the adhesive may be deposited on an area less than or equal to total surface area of the carrier layer 52 and/or the fabric layer 54.

The foregoing embodiments permit image formation on fabric layer 54 using antimicrobial toner. As described above with respect to attachment of a fabric layer 54 to a surface of the carrier layer 52, adhesive may be deposited on the carrier layer 52 and/or the fabric layer 54. Thus, in embodiments wherein the fabric layer 54 is wrapped about the carrier layer, adhesive, the same or different, may be applied to each surface of the carrier layer, and/or the non-image bearing surface of the fabric layer 54, as the image bearing surface will always be facing outwardly relative to the carrier layer, i.e., never contacting the carrier layer.

Figure 3:
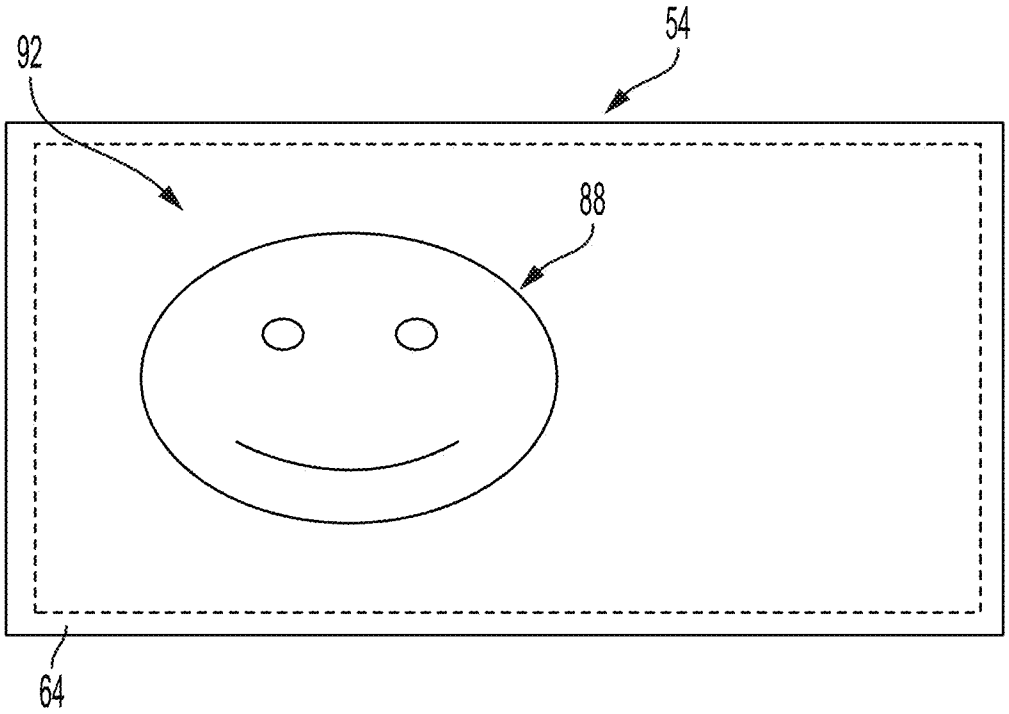
FIG. 3 is a plan view of a first surface of an embodiment of a fabric layer.

In some embodiments, shown in FIG. 3 the present disclosure includes a method of forming image 88 on fabric layer 54. Some embodiments of the method includes: releasably securing textile layer 54 to carrier layer 52, where carrier layer 52 comprises a surface 58 comprising area 60, surface 62 opposite surface 58, and a first rigidity, where fabric layer 54 comprises surface 64 having an area, surface 66 opposite surface 64, and a second rigidity less than the first rigidity, wherein fabric layer 54 is secured to carrier layer 52 by adhesive 56 bonding surface 66 to surface 58; applying a antimicrobial toner to a portion of surface 64 of fabric layer 54; and, fusing dry antimicrobial toner to portion of surface 64 with a fuser.

In some embodiments, the fabric layer may benefit from a "pre-treatment" step. For example, fabrics may be porous, and such porosity permits the passage of dry toner. However, an initial deposition of toner to, e.g., a base layer, prior to forming an image on the fabric may greatly reduce subsequent passage of marking material through the pores, thereby greatly increasing the final image quality. Thus, an initial deposition of a white dry marking material on a fabric may in effect fill the pores and provide a more consistent base media upon which an image may then be formed.

Additionally, in some embodiments, the printing system may include sensors used to detect the color of the print media, e.g., cream/natural colored cotton, prior to depositing a base layer. The printing system may then be configured to print that custom base layer on the fabric layer, i.e., a color matched base layer, prior to forming the image thereon. It should be appreciated that the foregoing custom base layer will result in a greater consistency of background/unprinted material and areas of the malleable material that do not receive marking materials, e.g., outer edges of the malleable material.

Similarly, in some embodiments, the first toner on the fabric layer may act as a base layer that alters the visual appearance of the first toner, e.g., a glittery or highly reflective layer, and/or may improve adhesion for subsequently deposited marking material, e.g., a primer layer. The foregoing embodiments fall within the scope of the claims directed to applying first and second marking materials.

Furthermore, the fabric layer 54 may include items that are already formed articles, e.g., t-shirts, blouses, pants, face masks. scarfs, etc. Such articles may be positioned on a carrier layer in an orientation that permits forming an image on one or more surfaces of the article, e.g., the front and/or back of a t-shirt. Similarly, houseware articles such as window treatments, e.g., curtains, shower curtains, towels, pillowcases, blankets, etc. may also be secured to a carrier layer for subsequent image formation thereon. In short, any fabric layer may be attached to a presently disclosed carrier layer in such a way as to permit forming an image on one or more locations on the material, and the material may already be a formed article.

The presently described fabric layer may be used in a variety of printing systems. For example, in FIG. 4, printer 113 in part comprises transfer belt 114, toner dispensers 116, 118, 120 and 122, ATA device 112 and fuser 94, while printer in part comprises transfer belt 114, toner dispensers 116, 118, 120, 122 and 126, ATA device 112 and fuser 94.

Figure 4:
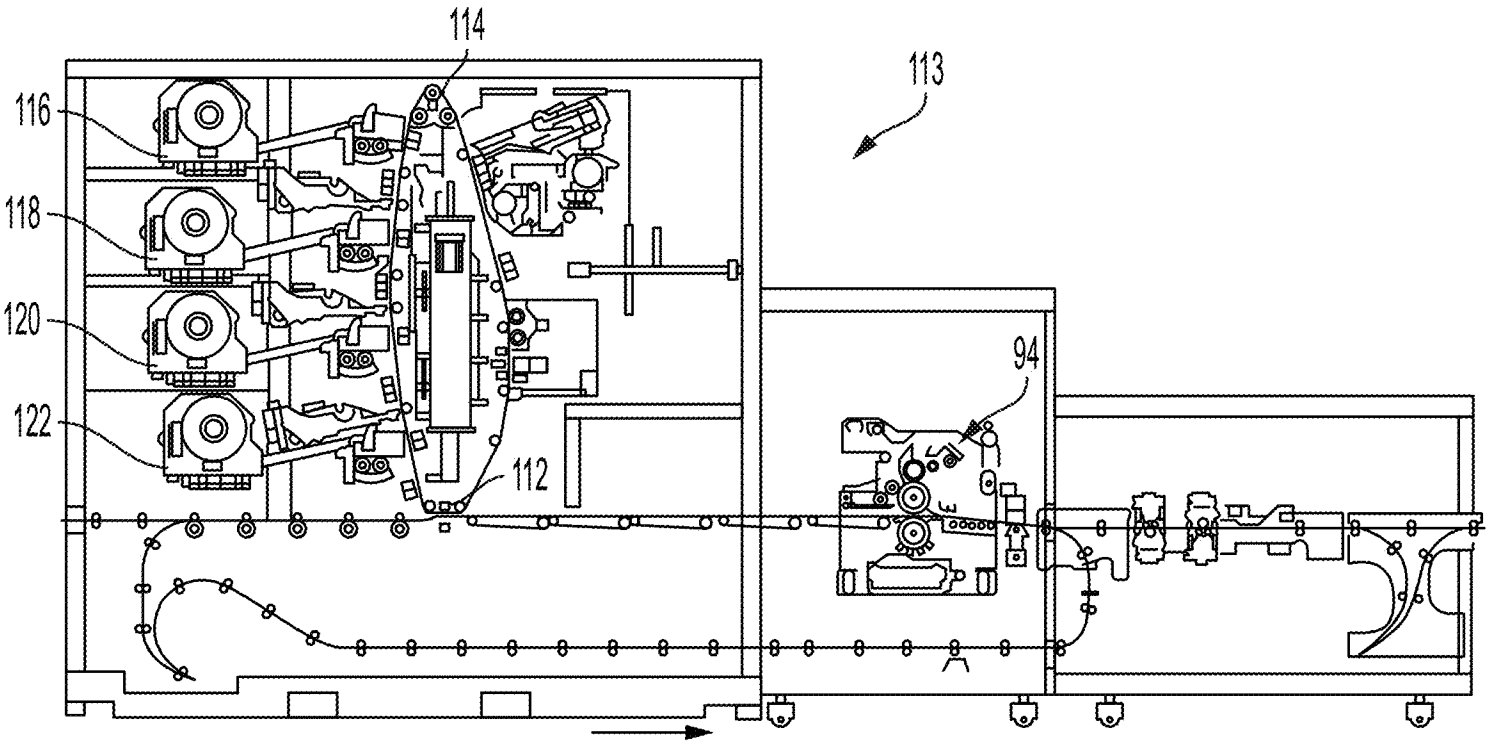
FIG. 4 is a side elevational view of an embodiment of a printing system having a single fuser and arranged to deposit antimicrobial toner on a fabric layer.

Moreover, some embodiments, e.g., embodiments including image formation by a toner, may benefit by printing systems that include what is known as an acoustic transfer assist (ATA) device. One of ordinary skill in the art will appreciate that printing systems that use a flexible belt in the process of forming an image thereon and subsequently transferring that image from the flexible belt to print media sometimes include one or more ATA devices (FIG. 4, 112). ATA devices use acoustic energy to drive the dry marking material, e.g., toner, from the belt to the print media. Thus, in some embodiments, an ATA device, such ATA device 112, assists with transferring a dry marking material from a belt to the malleable print media so that no direct contact between the belt and malleable material is necessary. It should be appreciated that such an arrangement may minimize image defects and thereby increase image quality.

Using the apparatus as shown in FIG. 4, the resolution of the image on the fabric layer is 600 dots per inch (dpi) to 2400 (dpi). In embodiments, the resolution can be from 1200 dpi to 2400 dpi. In embodiments, the resolution can be 600 dpi to 1200 dpi.

Antimicrobial Toner

Embodiments described herein can utilize EA toner technology to form antimicrobial toner particles that include silver nanoparticles for enhanced antibacterial properties. For example, such a toner that can include toner particles having a core/shell configuration (i.e., a shell formed around a core) with silver nanoparticles disposed in the shell. Upon delivering such toner particles and fusing them onto a fabric layer, the silver nanoparticles can be exposed to oxygen, thereby releasing silver ions that can act as powerful antimicrobials. The toner particles having silver nanoparticles in the shell have a size of from 4 μm to 20 μm.

The development of processes for the synthesis of core-shell organic/inorganic nanoparticles with precise positioning of the silver nanoparticles at the surface of the nanoparticle, as disclosed herein, provides reactive or stimuli-responsive colloidal particles that also have a well-defined structure, homogeneous encapsulation and well-defined morphology. Other issues that arise in conventional methods which are overcome by the methods herein include incompatibility between the polymer and inorganic material especially when highly hydrophobic monomers are used in any polymerization stage of the process.

Core-shell nanoparticles as functional composites for many device applications related to biomedical is described herein. As well, these core-shell materials are economically sound since the bulk or core is mainly organic while the shell contains organic material with more expensive precious metals such as gold, copper and silver.

Embodiments provide for the preparation and characterization of core-shell nanocomposites that selectively immobilize silver nanoparticles in the outer shell layer of the core-shell nanoparticles. The present methods disclosed herein are environmentally friendly processes for synthesizing silver nanoparticles that do not require the use of toxic chemicals. Methods herein provide green chemistry and biocompatibility in preparing hybrid organic/inorganic nanocomposites. The hybrid nanocomposites have the ability to take on inorganic characteristics related to coating performance (such as robustness) and thermal stability. Deliberate placement of the silver nanoparticles (AgNPs) in the shell provides easy accessibility of the silver for antimicrobial applications.

The silver-containing toner of embodiments described herein can be introduced as coatings for antibacterial applications (printing on apparel or other fabrics requiring antibacterial properties). The toner of embodiments described herein can be printed onto textile fabrics 54. Emulsion aggregation particles with or without pigment can be formulated to contain silver nanoparticles which can be printed onto textile fabrics.

In an embodiment, an emulsion polymerization composite resin latex can be used to prepare the antimicrobial toner particles, where the core comprises at least one styrene-acrylate polymer resin and a shell comprises at least one composite styrene/acrylate-metal ion polymer resin.

Nanoparticle Composite Latex

Embodiments herein provide methods of synthesizing composite nanoparticles, wherein metal ions, such as, silver ions, are immobilized in a shell (optionally, also in a core) of a core-shell resin particle. Placement of a metal composite ionomer in a shell provides accessibility of silver ions for antimicrobial applications.

A core may comprise any styrene/acrylate polymer resin useful for forming nanoparticles, such as, binder resins. Polymers may be synthesized using any of the styrene/acrylate monomers and/or comonomers mentioned above or known in the art, and optionally including a metal ion, by using known conventional methods in the art for forming resin polymers, including bulk polymerization, solution polymerization and emulsion polymerization; there are no intended limitations on the method of synthesizing polymers.

In embodiments, core resin particles are provided wherein the polymers are selected from poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkylacrylate), poly(alkyl methacrylate-aryl acrylate), poly(arylmethacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), poly(alkyl acrylate-acrylonitrile-acrylic acid), poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl aetylate-butadierte), poly(butyl acrylate-butadiene), poly(styrene-isoprene), poly(methystyrene-isoprene), poly(methyl methacrylate-isoprene), poly(ethylmethacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butylacrylate-methacrylic acid), poly(styrene-butyl acrylate-acrylonitrile), poly(styrene-butyl acrylate-acrylonitrile-acrylic acid), poly(styrene-butadiene), poly(styrene-isoprene), poly(styrene-butyl methacrylate), poly(styrene-butyl acrylate-acrylic acid), poly(styrene-butyl methacrylate-acrylic acid), poly(butyl methacrylate-butyl acrylate), poly(butyl methacrylate-acrylic acid), poly(acrylonitrile-butyl acrylate-acrylic acid) and combinations thereof.

In embodiments, a core is prepared via a polymerization reaction, wherein monomers are selected from styrene, alkyl acrylate, such as, methyl acrylate, ethyl acrylate, butyl acrylate, isobutyl acrylate, dodecyl acrylate, n-octyl acrylate, 2-chloroethyl acrylate; β-CEA, phenyl acrylate, methyl α-chloroacrylate, MMA, ethyl methacrylate and butyl methacrylate: butadiene; isoprene; methacrylonitrile; acrylonitrile; vinyl ethers, such as, vinyl methyl ether, vinyl isobutyl ether, vinyl ethyl ether and the like; vinyl esters, such as, vinyl acetate, vinyl propionate, vinyl benzoate and vinyl butyrate; vinyl ketones, such as, vinyl methyl ketone, vinyl hexyl ketone and methyl isopropenyl ketone; vinylidene halides, such as, vinylidene chloride and vinylidene chlorofluoride; N-vinyl indole; pyrrolidone; MA; acrylic acid; methacrylic acid; acrylamide; methacrylamide; vinylpyridine; vinylpyrrolidone; vinyl-N-methylpyridinium chloride; vinyl naphthalene; p-chlorostyrene; vinyl chloride; vinyl bromide; vinyl fluoride; ethylene; propylene; butylenes; isobutylene; and the like, and mixtures thereof.

In embodiments, a core particle optionally further comprises styrene/acrylate latex copolymers. Illustrative examples of a styrene/acrylate latex copolymer includes poly(styrene-n-butyl acrylate-β-CEA), poly(styrene-alkyl acrylate), poly(styrene-1,3-diene), poly(styrene-alkyl methacrylate), poly(alkyl methacrylate-alkyl acrylate), poly(alkyl methacrylate-aryl acrylate), poly(arylmethacrylate-alkyl acrylate); poly(alkyl methacrylate), poly(styrene-alkyl acrylate-acrylonitrile), poly(styrene-1,3-diene-acrylonitrile), poly(alkyl acrylate-acrylonitrile), poly(styrene-butadiene), poly(methylstyrene-butadiene), poly(methyl methacrylate-butadiene), polyethyl methacrylate-butadiene), poly(propyl methacrylate-butadiene), poly(butyl methacrylate-butadiene), poly(methyl acrylate-butadiene), poly acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly (styrene-propyl acrylate), poly(styrene-butyl acrylate), poly (styrene-butadiene-acrylonitrile), poly(styrene-butyl acrylate-acrylonitrile) and the like.

In embodiments, a metal acrylate is included in an emulsion. An example of a metal acrylate is a silver acrylate, such as, a silver methacrylate.

In embodiments, a core styrene/acrylate polymer resin optionally further comprises any of the above mentioned chain transfer agents and/or branching agents, including in the above mentioned amounts. A core styrene/acrylate polymer comprises a styrene monomer, an acrylate monomer, optionally a chain transfer agent and optionally a branching agent.

In embodiments, methods for preparing a latex comprised of composite antimicrobial nanoparticles. A core styrene/acrylate resin particles may be synthesized in an emulsion polymerization reaction, followed by polymerization of shell monomers on the surface of core particles. In alternative embodiments, a shell resin is formed and then added to the core particle emulsion to form a layer encapsulating the core particles.

Surfactants

Any suitable surfactant may be used for the preparation of a latex, pigment or wax dispersion according to the present disclosure. Depending on the emulsion system, any desired nonionic or ionic surfactant, such as, anionic or cationic surfactant, may be contemplated.

Examples of suitable anionic surfactants include, but are not limited to; sodium dodecylsulfate (SDS), sodium dodecylbenzene sulfonate, sodium dodecylnaphthalenesulfate, dialkyl benzenealkyl sulfates and sulfonates, abitic acid, NEOGEN R.™ and NEOGEN SC™ available from Kao, Tayca Power®, available from Tayca Corp., DOWFAX™, available from Dow Chemical Co., and the like, as well as mixtures thereof.

Examples of suitable cationic surfactants include, but are not limited to, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, C.sub.12,C.sub.15,C.sub.17-trimethyl ammonium bromides, halide salts of quaternized polyoxyethylalkylamines, dodecylbenzyl triethyl ammonium chloride, MIRAPOL™ and ALKAQUAT™ (available from Alkaril Chemical Company), SANIZOL™ (benzalkonium chloride, available from Kao Chemicals), and the like, as well as mixtures thereof.

Examples of suitable nonionic surfactants include, but are not limited to, polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol (available from sanofi as ANTAROX 890™, IGEPAL CA-210™, IGEPAL CA-520™, IGEPAL CA-720™, IGEPAL CO-890™, IGEPAL CO-720™, IGEPAL CO-290™, IGEPAL CA-210™ and ANTAROX 897™) and the like, as well as mixtures thereof.

Surfactants may be employed in any desired or effective amount, for example, at least about 0.01% by weight of the reactants, at least about 0.1% by weight of the reactants; no more than about 10% by weight of the reactants, no more than about 5% by weight of the reactants, although the amount can be outside of those ranges.

Initiator

A suitable initiator or mixture of initiators may be used in the latex process and the toner process. In embodiments, the initiator is selected from known free radical polymerization initiators. Examples of suitable free radical initiators include, but are not limited to, peroxides, pertriphenylacetate, tert-butyl performate, sodium persulfate, azo compounds and the like.

Based on total weight of the monomers to be polymerized, the initiator may be present in an amount from about 0.1 to about 5%, from about 0.4% to about 4%, from about 0.5% to about 3%, although may be present in greater or lesser amounts.

Chain Transfer Agent

A chain transfer agent optionally may be used to control the polymerization degree of the latex, and thereby to control the molecular weight and molecular weight distribution of the product latex. As can be appreciated, a chain transfer agent can become part of the latex polymer.

A chain transfer agent can have a carbon-sulfur covalent bond. Exemplary chain transfer agents include, but are not limited to, n-$C_{3-15}$ alkylmercaptans; branched alkylmercaptans; aromatic ring-containing mercaptans; and so on. Examples of such chain transfer agents also include, but are not limited to, dodecanethiol, butanethiol, isooctyl-3-mercaptopropionate, 2-methyl-5-t-butyl-thiophenol, carbon tetrachloride, carbon tetrabromide and the like. The terms, "mercaptan," and, "thiol," may be used interchangeably to mean a C—SH group.

Based on total weight of the monomers to be polymerized, the chain transfer agent may be present in an amount from about 0.1% to about 7%, from about 0.5% to about 6%, from about 1.0% to about 5%, although may be present in greater or lesser amounts.

Branching Agent

In embodiments, a branching agent optionally may be included to control the branching degree, crosslinking degree and/or structure of the target latex. Exemplary branching agents include, but are not limited to, decanediol diacrylate (ADOD), trimethylolpropane, pentaerythritol, trimellitic acid, pyromellitic acid and mixtures thereof.

Based on total weight of the monomers to be polymerized, the branching agent may be present in an amount from about 0.001% to about 2%, from about 0.05% to about 1.0%, from about 0.1% to about 0.8%, although may be present in greater or lesser amounts.

Method of Producing Toner

In the latex process and toner process of the disclosure, emulsification may be performed by any suitable process, such as, mixing, optionally, at elevated temperature. For example, the emulsion mixture may be mixed in a homogenizer set at about 200 to about 400 rpm and at a temperature of from about 20° C. to about 80° C. for a period of from about 1 min to about 20 min, although speed, temperature and time outside of those ranges can be used.

Any type of reactor to prepare the antimicrobial toner may be used without restriction. The reactor can include means for stirring the compositions therein, such as, an impeller. A reactor can include at least one impeller. For forming the latex and/or toner, the reactor can be operated such that the impeller(s) operate at an effective mixing rate of about 10 to about 1,000 rpm.

Following completion of monomer addition, the latex may be permitted to stabilize by maintaining the conditions for a period of time, for example for about 10 to about 300 min, before cooling. Optionally, the latex formed by the above process may be isolated by standard methods known in the art, for example, coagulation, dissolution, precipitation, filtering, washing, drying or the like.

A latex of the present disclosure may be melt blended or otherwise mixed with various toner ingredients, such as, an optional wax dispersion, an optional colorant, an optional coagulant, an optional silica, an optional charge enhancing additive or charge control additive, an optional surfactant, an optional emulsifier, an optional flow additive and the like. Optionally, the latex (e.g. around 40% solids) may be diluted to the desired solids loading (e.g. about 12 to about 15% by weight solids), before formulated into a toner.

Based on the total toner weight, a latex may be present in an amount from about 50% to about 98%, although may be present in lesser amounts. Methods of producing such latex resins may be carried out as described in U.S. Pat. No. 7,524,602, the entire content of which herein is incorporated by reference in entirety.

Optional Colorants

In embodiments, the antimicrobial toner particles optionally may comprise one or more colorants. In embodiments, the toner particles may be colorless or clear. Various known suitable colorants, such as dyes, pigments, mixtures of dyes, mixtures of pigments, mixtures of dyes and pigments and the like may be included in the toner. The colorant may be included in the toner in an amount of for example, 0 to about 35% by weight of the toner, from about 1 to about 25% of the toner, from about 3 to about 20% by weight of the toner, although amounts outside those ranges may be utilized.

As examples of suitable colorants, mention may be made of carbon black like REGAL 330™; magnetites, such as Mobay magnetites MO8029™ and MO8060™; Columbian magnetites; MAPICO BLACKS™, surface-treated magnetites; Pfizer magnetites CB4799™, CB5300™, CB5600™. and MCX6369™; Bayer magnetites, BAYFERROX 8600™ and 8610™; Northern Pigments magnetites, NP-604™ and NP-608™; Magnox magnetites TMB-100™ or TMB-104™; and the like. As colored pigments, there can be selected cyan, magenta, yellow, red, green, brown, blue or mixtures thereof. Generally, cyan, magenta or yellow pigments or dyes, or mixtures thereof, are used. The pigment or pigments can be water-based pigment dispersions.

Specific examples of pigments include SUNSPERSE 6000, FLEXIVERSE and AQUATONE water-based pigment dispersions from SUN Chemicals, HELIOGEN BLUE L6900™, D6840™, D7080™, D7020™, PYLAM OIL BLUE™, PYLAM OIL YELLOW™, PIGMENT BLUE I™ available from Paul Uhlich & Company, Inc., PIGMENT VIOLET I™, PIGMENT RED 48™, LEMON CHROME YELLOW DCC 1026™, E.D. TOLUIDINE RED™ and BON RED C.™ available from Dominion Color Corp., Ltd., Toronto, CA, NOVAPERM YELLOW FGL™, HOSTAPERM PINK E™ from sanofi, CINQUASIA MAGENTA™ available from E.I. DuPont de Nemours & Co. and the like. Colorants that can be selected are black, cyan, magenta, yellow and mixtures thereof. Examples of magenta colorants are 2,9-dimethyl-substituted quinacridone and anthraquinone dye identified in the Color Index (CI) as CI 60710, CI Dispersed Red 15, diazo dye identified in the Color Index as CI 26050, CI Solvent Red 19 and the like. Illustrative examples of cyans include copper tetra(octadecyl sulfonamido) phthalocyanine, x-copper phthalocyanine pigment listed in the Color Index as CI 74160, CI Pigment Blue, Pigment Blue 15:3, Anthrathrene Blue, identified in the Color Index as CI 69810, Special Blue X-2137 and the like. Examples of yellows are diarylide yellow 3,3-dichlorobenzidene acetoacetanilides, a monoazo pigment identified. In the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide and Permanent Yellow FGL. Colored magnetites, such as, mixtures of MAPICO BLACK™, and cyan components also may be selected as colorants. Other known colorants can be selected, such as, Levanyl Black A-SF (Miles, Bayer) and Sunsperse Carbon Black LHD 9303 (Sun Chemicals), and colored dyes, such as Neopen Blue (BASF), Sudan Blue OS (BASF), PV Fast Blue B2G01 (sanofi), Sunsperse Blue BHD 6000 (Sun Chemicals), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (sanofi), Permanent Yellow YE 0305 (Paul Uhlich), Lumogen Yellow D0790 (BASF), Sunsperse Yellow YHD 6001 (Sun Chemicals), Suco-Gelb L1250 (BASF), Suco-Yellow D1355 (BASF), Hostaperm Pink E (Sanofi), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann, C A), E.D. Toluidine Red (Aldrich), Lithol Rubine Toner (Paul Uhlich), Lithol Scarlet 4440 (BASF), Bon Red C (Dominion Color Co.), Royal Brilliant Red RD-8192 (Paul Uhlich), Oracet Pink RF (Ciba-Geigy), Paliogen Red 3871K (BASF), Paliogen Red 3340 (BASF), Lithol Fast Scarlet L4300 (BASF), combinations of the foregoing and the like.

Optional Wax

An antimicrobial toner of the present disclosure optionally may contain a wax, which can be either a single type of wax or a mixture of two or more different waxes. When included, the wax may be present in an amount of, for example, from about 1 wt % to about 25 wt % of the toner particles, from about 5 wt % to about 20 wt % of the toner particles. The melting point of a wax can be at least about 60° C., at least about 70° C., at least about 80° C. Waxes that may be selected include waxes having, for example, a weight average molecular weight of from about 500 to about 20,000, from about 1,000 to about 10,000. Wax particles can be from about 125 nm to about 250 nm, from about 150 to about 225 nm, from about 175 to about 200 nm in size.

Waxes that may be used include, for example, polyolefins, such as, polyethylene, polypropylene and polybutene waxes, such as, commercially available from Allied Chemical and Petrolite Corporation, for example POLYWAX™ polyethylene waxes from Baker Petrolite, wax emulsions available from Michaelman, Inc. and the Daniels Products Company, EPOLENE N15™ commercially available from Eastman Chemical Products, Inc., and VISCOL 550-P™, a low weight average molecular weight polypropylene available from Sanyo Kasei K.K.; plant-based waxes, such as, carnauba wax, rice wax, candelilla wax, sumacs wax and jojoba oil; animal-based waxes, such as, beeswax; mineral-based waxes and petroleum-based waxes, such as, montan wax, ozokerite, ceresin, paraffin wax, microcrystalline wax and Fischer-Tropsch wax; ester waxes obtained from higher fatty acid and higher alcohol, such as, stearyl stearate and behenyl behenate; ester waxes obtained from higher fatty acid and monovalent or multivalent lower alcohol, such as, butyl stearate, propyl oleate, glyceride monostearate, glyceride distearate, pentaerythritol tetra behenate; ester waxes obtained from higher fatty acid and multivalent alcohol multimers, such as, diethyleneglycol monostearate, dipropyleneglycol distearate, diglyceryl distearate and triglyceryl tetrastearate; sorbitan higher fatty acid ester waxes, such as, sorbitan monostearate, and cholesterol higher fatty acid ester waxes, such as, cholesteryl stearate. Examples of functionalized waxes that may be used include, for example, amines, amides, for example, AQUA SUPERSLIP 6550™ SUPERSLIP 6530™ available from Micro Powder Inc., fluorinated waxes, for example, POLYFLUO 190™, POLYFLUO 200™, POLYSILK 19™ and POLYSILK 14™ available from Micro Powder Inc., mixed fluorinated, amide waxes, for example, MICROSPERSION 19™ available from Micro Powder Inc., imides, esters, quaternary amines, carboxylic acids or acrylic polymer emulsion, for example JONCRYL 74™, 89™, 130™, 537™ and 538™, all available from SC Johnson Wax, and chlorinated polypropylenes and polyethylenes available from Allied Chemical and Petrolite Corporation and SC Johnson wax. Mixtures and combinations of the foregoing waxes also may be used in embodiments.

Shell

The toner particles of the present disclosure comprise a shell surrounding aggregated core particles, where is the shell comprises metal (I) ions. Silver metal ions are known to possess antimicrobial properties and may be referred to as an antimicrobial metal ion. Suitable antimicrobial metals and metal ions include, but are not limited to, silver, copper, zinc, gold, mercury, tin, lead, iron, cobalt, nickel, manganese, arsenic, antimony, bismuth, barium, cadmium, chromium and thallium. In embodiments, metal oxides, e.g., zinc oxide, magnesium oxide, aluminum oxide copper oxide, titanium dioxide can be used as antimicrobial particles. Metal ions of silver, copper, zinc and gold or combinations thereof, for example, are considered safe for human contact. Hence, silver ions, alone or in combination with copper or zinc or both, for example, have a high ratio of efficacy to toxicity, i.e., high efficacy to low toxicity.

For example, a combination of silver and copper ions provides both an antibacterial property of silver ions and an antifungal property of copper ions. Thus, one is able to tailor the toner particles by selection of specific metal ions and combinations thereof incorporated into the shell surrounding, the core particles of the toner for particular end-use applications.

The shell comprises a metal ion, such as, AgNP's. In embodiments, the shell further comprises a styrene/acrylate resin and/or a polyester resin. In embodiments, a shell can include reagents that are not antimicrobial, such as, a resin, a conductive material, such as, a colorant and so on, as is known in the art. A shell can cover all of or a portion of the exterior surface of a core toner particle.

The particle size of the metal nanoparticles is determined by the average diameter of the particles. The metal nanoparticles may be a particle size in a range from about 5 nm to about 500 nm, from about 10 nm to about 200 nm, from about 20 nm to about 50 nm.

In embodiments, the metal nanoparticles have an average diameter of from about 1 nm to about 15 nm, or from about 3 nm to about 10 nm. In embodiments, metal nanoparticles may have a uniform particle size with a narrow particle size distribution. The particle size distribution can be quantified using the standard deviation of the average particle size of a population. In embodiments, the metal nanoparticles have a narrow particle size distribution with an average particle size standard deviation of about 3 nm or less, or about 2.5 nm or less. In embodiments, the metal nanoparticles have an average particle size of from about 1 nm to about 10 nm with a standard deviation of from about 1 nm to about 3 nm. Without being limited by theory, it is believed that small particle size with a narrow particle size distribution enable the metal nanoparticles to disperse easier when placed in a solvent, and can offer a more uniform coating of or on a core toner particle.

In embodiments, the metal nanoparticles may comprise solely elemental silver or may be a silver composite, including composites with other metals. Such silver composites may include either or both of (i) one or more other metals and (ii) one or more non-metals. Suitable other metals include, for example Al, Au, Pt, Pd, Cu, Co, Cr, In and Ni, such as, the transition metals, for example, Au, Pt, Pd, Cu, Cr, Ni and mixtures thereof. Exemplary metal composites are Au—Ag, Ag—Cu, Au—Ag—Cu and Au—Ag—Pd. Suitable non-metals in the silver composite include, for example, Si, C and Ge. The various non-silver components of the silver composite may be present in an amount ranging, for example, from about 0.01% to about 99.9% by weight, from about 10% to about 90% by weight. In embodiments, the silver composite is a metal alloy composed of silver and one, two or more other metals, with silver comprising, for example, at least about 20% of the nanoparticle by weight, greater than about 50% of the nanoparticle by weight. Unless otherwise noted, the weight percentages recited herein for the components of the silver-containing nanoparticles do not include a stabilizer.

Silver nanoparticles composed of a silver composite can be made, for example, by using a mixture of: (i) a silver compound (or compounds, such as, a silver (I) ion-containing compound); and (ii) another metal salt (or salts) or another non-metal (or non-metals) during a reduction step. In embodiments, a surfactant solution may be prepared, such as, with an anionic surfactant and water, heated and purged with nitrogen. Once thermal equilibrium is reached, an emulsion (optionally including a surfactant) of the core monomers, including styreneiacrylate monomers (c.a. styrene and butyl-acrylate), an optional chain transfer monomer and an optional branching monomer may be added slowly, such as drop wise, to the heated aqueous surfactant solution. An aqueous solution of initiator, such as ammonium or potassium persulfate, may be slowly added to the reactor to form the core resin polymers.

Following formation of the core latex, an emulsion of shell monomers may be prepared and added to the emulsion of core particles wherein a shell comprising composite styrene/acrylate-metal ion polymer resin can be formed covering a part of or encapsulating, that is, covering the whole or entirety, of the surface of core particles. In forming a shell emulsion, shell monomers, e.g. silver (meth)acrylate and methyl methacrylate, optional chain transfer monomer, optional chain branching monomers may be added to an aqueous solution optionally comprising a surfactant. A shell emulsion may be added to the reactor containing optionally heated core particle latex, which forms, "surface seeds," on core resin particles. To complete polymerization of the shell resin, an aqueous solution of initiator, such as ammonium or potassium persulfate, may be slowly added to the reactor. Following addition of all reactants, the emulsion may be mixed and the heat maintained for an extended period of time, such as, about 6-24 hours. Following completion of the polymerization reaction, the emulsion can be cooled and the resin particles may be filtered or sieved, such as with a 25 μm screen.

In embodiments, shell monomers comprise at least one metal acrylate monomer described above and a styrene/acrylate monomer, also described above, in embodiments, a shell comprises a polymer comprising a metal methacrylate and/or metal acrylate, such as, silver acrylate or silver methacrylate.

Composite antimicrobial nanoparticles can be from about 5 nm to about 500 nm or from 10 to about 200 nm in size, or from about 25 to about 150 nm, from about 50 to about 100 nm in size. Composite nanoparticles may be smaller in size, as measured by, for example, dynamic light scattering, than composite resin particles. That may be due to polymerization in situ of a shell resin, instead of forming a shell resin and then adding, to core particles. Polymerization of a composite ionomer resin may result in entanglement of ionic polymer chains, as measured by molecular weight, wherein particles have a larger diameter than those of the composite nanoparticles. Furthermore, interaction between ionic metal of a composite resin and carboxyl groups acts as ionic crosslinks that may have an effect on properties of a composite ionomer and nanoparticles comprising those composite ionomers, such as solubility in chemical solvents, $T_g$, molecular weight and water sensitivity.

In embodiments, toner particles may comprise a composite styrene acrylate ionomer resin. In the instance of core-shell toner particles, that ionomer resin may be present in the core, in the shell or both. In the instance of core-shell toner particles, that composite nanoparticle may be present in the core, in the shell or both. Methods are well known for preparing toner particles, including emulsion aggregation methods that produce toner particles comprising a core and shell, including as described in U.S. Pat. Nos. 5,302,486; 6,294,306; 7,985,526; and 8,383,310, each of which herein is incorporated by reference in entirety.

Thus, an ionomer of interest or a core-shell particle of interest can be combined with an optional other resin, such as, a different or non-metal ion containing styrene/acrylate resin, a polyester resin and so on, optional surfactant, optional wax, optional colorant and any other toner reagent to form nascent toner particles, for example, by emulsion aggregation. After growth to art appropriate size, such as, from about 2 μm to about 8 μm, toner particles can be finished, for example, polishing the surface of the toner particles to form smooth and circular particles for use as toner in any known imaging material and method, where toner is displayed imagewise on a fabric layer.

The binder resin core can further comprise at least one of an additional resin, a wax, a coagulant, and a stabilizer. In an embodiment, the binder resin core consists essentially of a binder resin and at least one of an additional resin, a wax, a coagulant, and a stabilizer. In an embodiment, the binder resin core comprises an amorphous polyester, and, optionally, a crystalline polyester.

Figure 5:
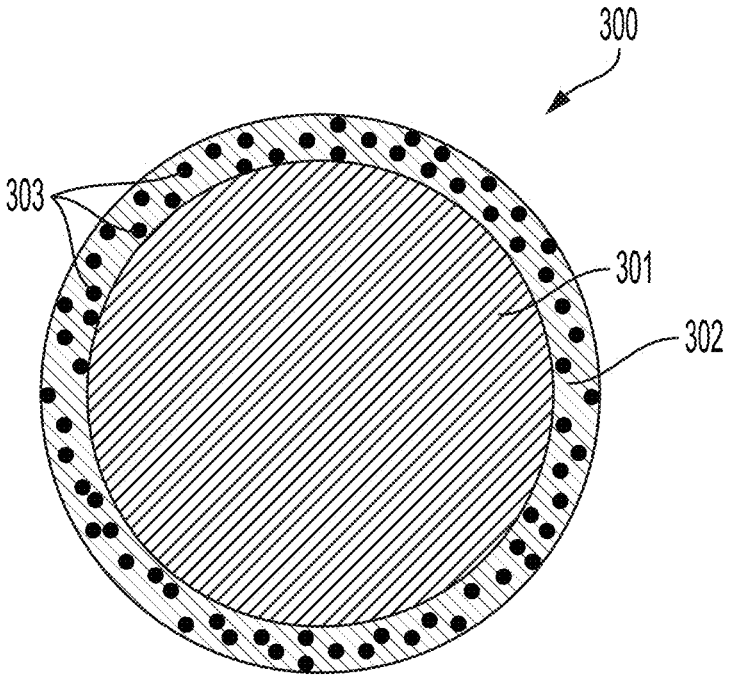
FIG. 5 is a cross-sectional view of antimicrobial toner.

In an embodiment, a antimicrobial toner can include a plurality of toner particles. As shown in FIG. 5, each toner particle 300 can include a binder resin core 301 and a shell 302 disposed about the binder resin core. The binder resin core 301 can include one binder resin. The shell 302 can include a plurality of metal nanoparticles 303. For example, the shell 302 can be formed of a matrix material in which metal nanoparticles 303 are disposed. The shell can have a shell thickness of between about 0.001 μm and about 2.0 μm. In an embodiment, the toner particles can comprise between about 0.00001 wt % and about 10 wt % or between about 0.01 wt % to 10 wt % metal nanoparticles by weight of the toner particles. The binder resin core can be prepared by a method that includes forming an aggregate of the binder resin. To avoid inclusion of metal nanoparticles from being incorporated in the binder resin core, the aggregate of the binder resin should not be formed in the presence of metallic nanoparticles.

The binder resin core 301 can be encapsulated in shell 302. In addition to the metal nanoparticles, the shell can include a matrix in which the metal nanoparticles are disposed, for example a matrix formed of a resin, such as an amorphous polyester resin. The shell can be free of crystalline polyesters. In an embodiment, the shell matrix is the same resin as the binder resin of the core. In another example, the shell matrix is formed of a resin having a higher Tg than a Tg of the core's resin.

In an embodiment, each metal nanoparticle can include silver (Ag) nanoparticles. Silver nanoparticles formed in the shell portion of the toner particles can be sourced from a silver nanopowder, such as redispersible dried silver nanopowders available from NanoComposix (San Diego, Calif.) that are formulated with polymer or alkanethiol surface coatings which allow the nanoparticles to easily be redispersed as unagglomerated dispersions in a variety of solvents. Preferred silver nanopowders include nanoparticles with polyvinylpyrrolidone (PVP) surface coating of only 0.3% to 4.0% mass percent and the size of the nanopowders range from 10-100 nm with narrow distributions (coefficient of variation (CV)<15%). Organic dispersible silver nanopowders that do not agglomerate after dispersion into hexane, toluene, chloroform, and many other organic solvents can be used in the embodiments. These silver nanoparticles may be available with a size of 4 nm (CV<20%). In embodiments, other silver nanoparticles formed in the shell portion of the toner particles can be those of 10 nm, 20 nm, 40 nm, 60 nm, and 100 nm in diameter with a citrate-stabilized surface at concentrations of 0.02 mg/mL such as those available from Sigma-Aldrich (St. Louis, Mo.; Product Nos. 730785, 730777, 730793, 730807, 730815).

Silver nanoparticles can be synthesized. For example, a 100 mL deionized water (DIW) ice-chilled aqueous solution of $1.0\times10^{-3}$ M silver nitrate can be mixed with a 300 mL DIW ice-chilled aqueous solution of $2.0\times10^{-3}$ M sodium borohydride. On mixing both solutions, Ag ions are reduced to form mono dispersed nanoparticles as a transparent solution in aqueous medium. The reaction can described in the following equation:

$$AgNO_3 + NaBH_4 \rightarrow Ag + \tfrac{1}{2}H_2 + \tfrac{1}{2}B_2H_6 + Na{-}NO_3$$

The Ag solution formed is yellow in color because of the absorption at about 400 nm, which is characteristic of silver nanoparticles due to the excitation of surface plasmons. The solution can be stirred repeatedly upon color darkening (for approximately an hour) until stabilized. The Ag nanoparticles solution stabilizes and may not change color for about three months without any stabilizing agent.

Toner particles can be deposited to form a print image 88 as shown in FIG. 3. Substantially all of the toner particles or each toner particle 300 (FIG. 5) can include a binder resin core 301 (FIG. 5) and a shell 302 (FIG. 5) disposed about the binder resin core. The binder resin core 301 (FIG. 5) can include at least one of a binder resin. The shell 302 can include a plurality of metal nanoparticles 303 (FIG. 5). The binder resin core can be prepared by a method that includes forming an aggregate of the binder resin. To avoid inclusion of metal nanoparticles from being incorporated in the binder resin core, the aggregate of the binder resin should not be formed in the presence of metallic nanoparticles.

The hydrophobicity of the antimicrobial image prevents droplets from passing through the fabric. A water droplet stays on the surface of a printed cotton sheet before it gets absorbed for up to 60 seconds with an antimicrobial toner image disclosed above. Bare cotton absorbs water in less than one second.

Woven cotton fabrics typically have a pore size of from 1 μm to 5 μm. Chiffon and silk have a larger bigger pore size. Canvas has a smaller pore size.

The present disclosure leverages known and recently developed hardware arrangements for image formation and fuser/dryer technology with a fabric, enabling very practical applications for printing on fabrics, such as cotton (natural and synthetic), canvas, chiffon, silk etc. In addition to facilitating high image quality printing on malleable materials, the present disclosure also describes how the printable format size can be greatly increased over known system capabilities.

The smaller the pore size in the fabric used to make the mask the more effective the antimicrobial AgNP printed images because it will cover more surface area. Therefore, the fabric can become N95 quality by printing all solid layers of toners on top of each other (up to 5 layers in iGen). This layering scheme will close off some of the pores in the fabric (0.5 μm pores) to the N95 range (0.3 μm pores).

Face masks come in many varieties. They are rated based on ability to filter very small particulates. Disclosed herein is antimicrobial protection via printed patterns with silver nanoparticles on any of the fabric layers (typically there are at least 3). The outer layer also gets a fashionable look.

The smaller the pore size in the fabric used to make the item such as a face mask, scarf, tee shirt, bandanna, the more effective the antimicrobial AgNP printed image as the image covers more surface area. Therefore, a woven fabric could become N95-ish quality by printing all solid layers of toners on top of each other (up to 5 layers in iGen).

It will be appreciated that various of the above-disclosed and other features and functions, or alternatives thereof, may be desirably combined into many other different systems or applications. Various presently unforeseen or unanticipated alternatives, modifications, variations or improvements therein may be subsequently made by those skilled in the art which are also intended to be encompassed by the following claims.

EXAMPLES

The method of producing a type of fabric layer with antimicrobial properties using silver nanoparticles via printing is disclosed.

Figure 6A:
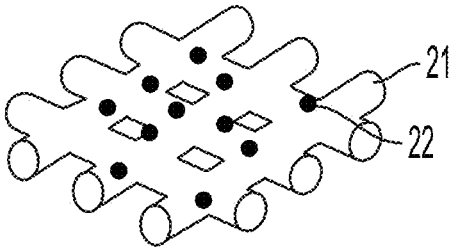
FIGS. 6A, 6B and 6C show antimicrobial toner particles printed on a fabric.
Figure 6B:
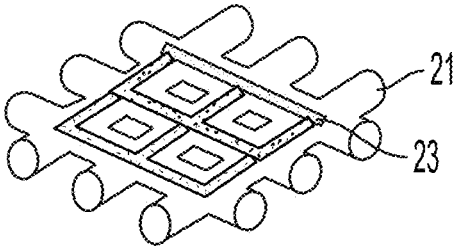
Figure 6C:
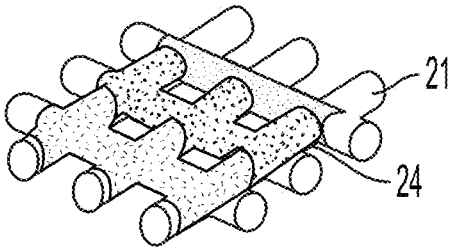

In FIG. 6A, showing current methods, the fabric 21 is impregnated with AgNPs 22. The AgNPs 22 are randomly dispersed throughout the fibers of the fabric 21. FIG. 6B shows an embodiment disclosed herein, in which the fibers of the fabric 21 are coated with fused antimicrobial toner 23. In an embodiment disclosed herein, using Acoustic Transfer Assist (ATA) technology as seen in FIG. 6C, the fibers of the fabric 21 are coated to a depth of 60 μm to 100 μm with fused antimicrobial toner 24. Using ATA allows one to better coat the fibers, providing better antimicrobial protection.

Figure 7:
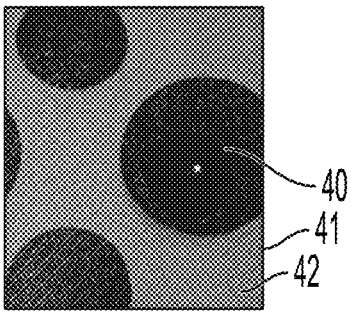
FIG. 7 shows water drop absorption on a fabric printer with antimicrobial toner particles.

FIG. 7 shows a water droplet 40 on a cotton fabric printed 41 with antimicrobial toner 42 described above. The water droplet was not absorbed by the cotton fabric for at least 60 seconds.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A method of forming an image on a fabric comprising:

providing a printable media comprising: a carrier layer comprising a first surface comprising a first area, a second surface opposite the first surface, and a first rigidity; a fabric layer comprising a third surface, a fourth surface opposite the third surface and comprising a second area, and a second rigidity less than the first rigidity; and, an adhesive, wherein the fabric layer is secured to the carrier layer by bonding a first portion of the fourth surface to the first surface;

applying a pretreatment to the fabric layer by depositing a white dry marking material on the fabric layer, and the white dry marking material filling into one or more of pores in the fabric layer;

applying a toner to a first portion of the third surface of the fabric layer, wherein the toner comprises a size of from 4 microns to about 20 microns, wherein the toner includes antimicrobial nanoparticles on an outer surface of the toner, the antimicrobial nanoparticles having a size of from 5 nanometers to 500 nanometers; and fusing the toner to the first portion of the third surface of the fabric layer.

2. The method of claim 1, wherein the fused toner forms an image having a resolution of from 600 dpi to 2400 dpi.

3. The method of claim 1, wherein the fused toner forms an image upon which a water droplet is not absorbed for at least 60 seconds.

4. The method of claim 1, wherein the fabric layer is selected from the group consisting of: cotton, chiffon, silk and canvas.

5. The method of claim 1, wherein the fabric layer having the fused toner has a pore size of less than 3 microns.

6. The method of claim 1, wherein the antimicrobial nanoparticles comprise silver.

7. The method of claim 1, wherein the toner comprises a polyester resin.

8. The method of claim 7, wherein the polyester resin is amorphous or crystalline.

9. The method of claim 1, wherein applying the pretreatment to the fabric layer is done prior to applying a toner to the fabric layer.

10. A printed article comprising:

a fabric having a first surface and a second surface opposite the first surface;

a pre-treatment layer disposed on the first surface of the fabric, wherein the pre-treatment layer comprises a white dry marking material that fills in one or more of pores in the fabric, and a porosity of the first surface of the fabric is reduced compared to the first surface of the fabric without the pre-treatment layer; and a toner image disposed on the pre-treatment layer, wherein the toner image comprises toner particles having a size of from 4 microns to about 20 microns and antimicrobial nanoparticles on an outer surface of the toner, the antimicrobial nanoparticles have a size of from 5 nanometers to 500 nanometers.

11. The printed article of claim 10, wherein the toner image has a resolution of 600 dpi to 2400 dpi by 2400 dpi.

12. The printed article of claim 10, wherein the fused toner forms an image upon which a water droplet is not absorbed for at least 60 seconds.

13. The printed article of claim 10, wherein the fabric is selected from the group consisting of: cotton, chiffon, silk and canvas.

14. The printed article of claim 10, comprising a face mask.

15. The printed article of claim 14, having a pore size of less than 3 microns.

16. The printed article of claim 10, wherein the antimicrobial nanoparticles comprise silver.

17. The printed article of claim 10, wherein the toner comprises a polyester resin.

18. The printed article of claim 17, wherein the polyester resin is amorphous or crystalline.

19. A method of forming an image on a fabric comprising:

providing a printable media comprising: a carrier layer comprising a first surface comprising a first area, a second surface opposite the first surface, and a first rigidity; a fabric layer comprising a third surface, a fourth surface opposite the third surface and comprising a second area, and a second rigidity less than the first rigidity; and, an adhesive, wherein the fabric layer is secured to the carrier layer by adhesive bonding a first portion of the fourth surface to the first surface;

applying a pretreatment to the fabric layer, wherein the pretreatment comprises depositing a white dry marking material on the fabric layer, and the white dry marking material filling into one or more of pores in the fabric layer;

applying a toner to a first portion of the third surface of the fabric layer, wherein the toner comprises a size of from 4 microns to about 20 microns, wherein the toner includes antimicrobial nanoparticles, the antimicrobial nanoparticles have a size of from 5 nanometers to 500 nanometers; and fusing the toner to the first portion of the third surface of the fabric layer to form a fused toner image.

20. The method of claim 19, wherein the toner is applied using acoustic transfer technology.

21. The method of claim 19, wherein the fused toner forms an image has a resolution of from 600 dpi to 2400 dpi.

22. A printed article comprising:

a fabric having first surface and a second surface opposite the first surface;

a pre-treatment layer disposed on the first surface of the fabric, wherein the pre-treatment layer comprises a white dry marking material that fills in one or more of pores in the fabric, and a porosity of the first surface of the fabric is reduced compared to the first surface of the fabric without the pre-treatment layer; and a toner image disposed on the pre-treatment layer, wherein the toner image comprises toner particles having a size of from 4 microns to about 20 microns and antimicrobial nanoparticles, the antimicrobial nanoparticles have a size of from 5 nanometers to 500 nanometers, wherein the toner image has a resolution of from 600 dpi to 2400 dpi.

23. The printed article of claim 22, wherein the antimicrobial toner particles are selected from the group consisting of: silver, copper, zinc, gold, mercury, tin, lead, iron, cobalt, nickel, manganese, arsenic, antimony, bismuth, barium, cadmium, chromium and thallium, zinc oxide, magnesium oxide, aluminum oxide copper oxide and titanium dioxide.

24. The printed article of claim 22, wherein, the fabric is selected from the group consisting of: cotton, chiffon, silk and canvas.

* * * * *